United States Patent [19]

Journey

[11] 4,160,623

[45] Jul. 10, 1979

[54] DEEP WELL PUMP

[75] Inventor: William K. Journey, Greenwood, Miss.

[73] Assignee: Preussag Aktiengesellschaft, Hanover and Berlin, Fed. Rep. of Germany

[21] Appl. No.: 690,012

[22] Filed: May 26, 1976

[30] Foreign Application Priority Data

Jul. 9, 1975 [DE] Fed. Rep. of Germany ..... 2530504
Jul. 9, 1975 [DE] Fed. Rep. of Germany ..... 2530576

[51] Int. Cl.[2] ..... F04B 21/04; F04B 21/06
[52] U.S. Cl. ..... 417/238; 417/552
[58] Field of Search ..... 417/451, 211, 329, 545–554, 417/238; 92/170; 294/69 R

[56] References Cited

U.S. PATENT DOCUMENTS

| | | | |
|---|---|---|---|
| Re. 18,791 | 4/1933 | Ruthven | 417/554 |
| 2,160 | 7/1841 | Van Allen | 417/451 |
| 226,126 | 10/1882 | Fowler | 417/551 |
| 320,737 | 6/1885 | Wock | 417/550 |
| 497,302 | 5/1893 | Burke | 166/105 |
| 787,621 | 4/1905 | Graham | 417/554 |
| 858,901 | 7/1907 | Nagel | 417/238 |
| 1,031,248 | 7/1912 | Conrader | 166/105.2 |
| 1,043,279 | 11/1912 | Wheeler | 417/451 |
| 1,761,876 | 6/1930 | Crull | 417/552 |
| 1,929,827 | 10/1933 | Roberts | 417/430 |
| 2,231,820 | 2/1941 | Smoot | 417/238 |
| 2,435,407 | 2/1948 | Pryor | 166/105 |
| 2,590,245 | 3/1952 | Harbison | 166/105.4 |
| 2,697,001 | 12/1954 | McGraw | 294/69 R |
| 2,883,246 | 4/1959 | Hatch | 417/554 |
| 2,922,380 | 1/1960 | Pedlow, Jr. et al. | 92/170 |
| 2,948,231 | 8/1960 | Hart | 417/439 |
| 2,991,724 | 7/1961 | Crowl | 137/533.13 |
| 3,174,437 | 3/1965 | Street | 417/554 |
| 3,651,635 | 3/1972 | Clay | 417/329 |
| 3,684,410 | 8/1972 | Fitzgerald | 417/554 |
| 3,689,206 | 9/1972 | Meripol | 417/547 |

FOREIGN PATENT DOCUMENTS

| | | | |
|---|---|---|---|
| 461378 | 11/1949 | Canada | 417/552 |
| 501197 | 4/1954 | Canada | 417/547 |

*Primary Examiner*—William L. Freeh
*Attorney, Agent, or Firm*—Allegretti, Newitt, Witcoff & McAndrews

[57] ABSTRACT

A deep well pump includes a cylinder having a foot valve and a valved piston which is movable over a given range in the cylinder. The cylinder is preferably formed of plastic, extends above ground and below the range of movement of the piston, and is of constant diameter over its length. The piston rod also extends above ground and is of variable length to vary the range of movement of the piston. The foot valve structure and piston structure are interchangeable and connected together during operation by a slackened cable.

13 Claims, 1 Drawing Figure

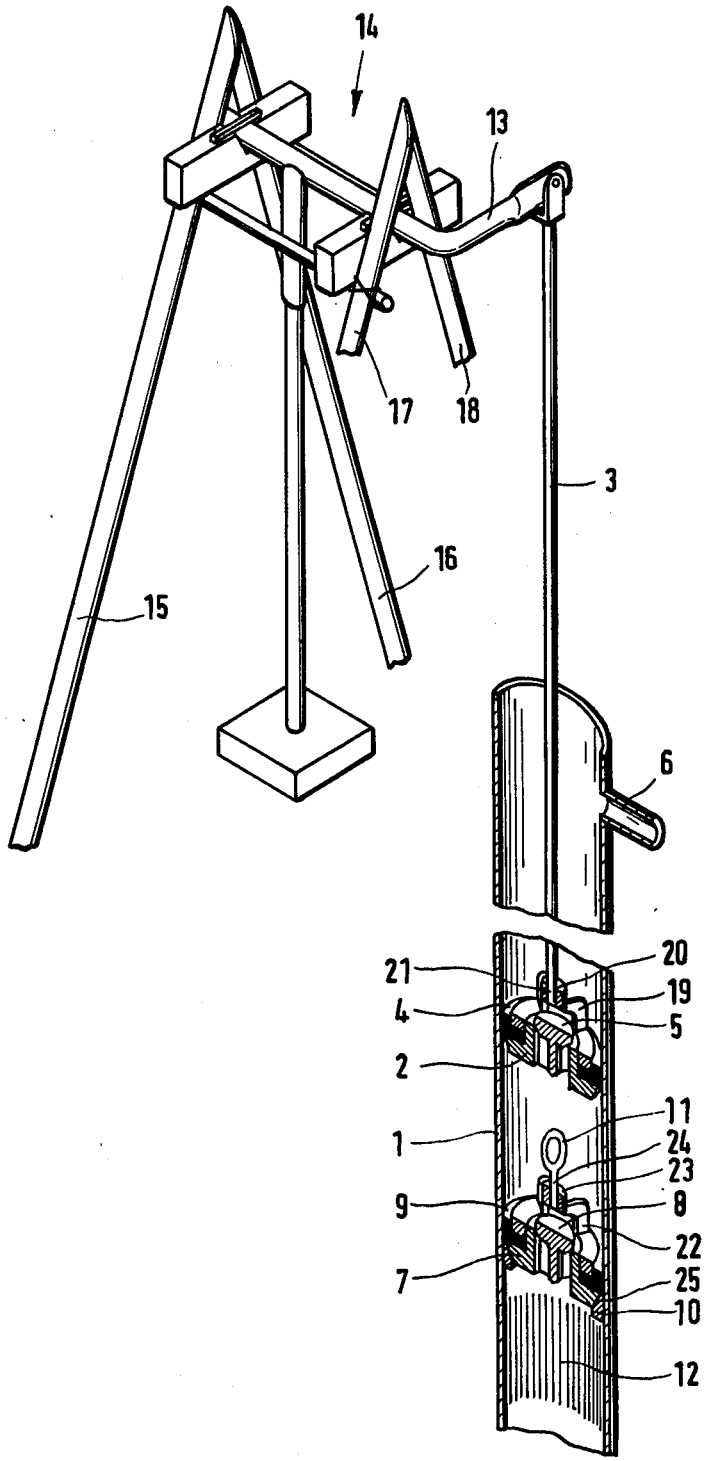
14
13
17
18
3
16
15
6
21
20
19
4
5
2
11
1
24
23
9
8
22
7
25
10
12

DEEP WELL PUMP

This invention relates to a deep well pump, comprising a cylinder, a foot valve and a piston in which a valve is situated, and a piston rod which extends from the piston to above ground.

Axelson pumps are well known as deep well pumps. These pumps comprise a cylinder, a foot valve, a piston, a valve in the piston and a piston rod. In such pumps, the pump is screwed onto the lower end of a riser pipe and installed together with the pipe. The piston rod extends to above ground level where it is driven. A disadvantage of this known deep well pump is its installation in the riser pipe, resulting in relatively complicated maintenance, since the entire riser pipe has to be removed on each occasion that pump repairs are necessary.

In the typical known linkage pumps, also known as insertion pumps, the pump is lowered on the pump linkage down through a riser pipe. Therefore, these pumps must be of very small diameter. Moreover, a seal between the pump and the lower end of the riser pipe is necessitated.

One of the principal purposes of the present invention is to provide a simple deep well pump, which is economical to manufacture, simple to install and can be easily and rapidly maintained or repaired.

In the present invention the cylinder, which extends upwards beyond the range of movement of the piston, comprises a tube extending above ground which has a constant diameter over its entire length. This cylinder also constitutes the riser pipe, so that the riser pipe itself can be omitted. The cylinder can also, simultaneously, constitute the casing tube of the well or, viewed in another way, the casing tube of the well constitutes the cylinder of the pump. Therefore, the casing is utilized as the cylinder for the pump, so that the additional parts necessary for the pump now consist only of a piston and a foot valve. The total costs for a deep well installation, for example for irrigation of fields, are therefore substantially reduced by the pump of the present invention.

Moreover, since the cylinder extends above ground, it is also simple to lift out the piston on the piston rod for maintenance purposes. Maintenance can, therefore, be carried out rapidly and by inexperienced persons.

In a further embodiment of the invention, the cylinder extends downward beyond the range of movement of the piston and preferably, includes filtering slits in this lower portion. Thus, in this embodiment, the casing tube, pump cylinder, riser pipe and filter tube all are of one piece construction. It is of course also possible for the cylinder, the casing tube and the filter tube to be assembled in known manner from separate lengths of tube.

In still a further embodiment of the invention, the cylinder is constructed of a plastic material. The use of plastics for cylinders is itself known. However, the use of plastic tubes for well casings are not usually suitable as pump cylinders, so that it would be expected that the pump cylinder of the present invention would be constructed of metal. However, the use of plastics for the pump cylinder in the present invention is possible, because according to a further embodiment of the invention, the length of the piston rod or other piston actuating mechanism can be varied so as to reposition the range of movement of the piston. Thus, when the path swept by the piston inside the cylinder becomes worn, the range of movement of the piston may be simply changed so that the piston will slide upon another part of the cylinder which has not yet become worn.

In still a further embodiment of the invention, the piston drive is supported and mounted separately and independently from the cylinder. This separate support and mounting of the drive has the advantage that the cylinder is not subjected to the drive forces, as is frequently the case in previously known deep well pumps. This advantage is of significance especially where the cylinder is of plastic material, since the cylinder is completely relieved of any pump loadings and is loaded solely by the static pressure of the fluid which is being pumped. An additional advantage of such separate mounting is that, as with a normal casing tube, the pressure of the water column in the cylinder acts in opposition to the external pressure, so that the total loading is considerably reduced.

In still a further embodiment of the invention, the piston rod is a cable and the piston is loaded by a weight. The use of a cable or rope, instead of a rigid piston rod, is of special advantage in lifting the piston out of the cylinder, since it is not necessary to disassemble the piston rod into individual parts during such operation.

In still a further embodiment of the invention, the foot valve is disposed in a foot valve supporting member, which has the same dimensions as the piston and rests upon an internal projection in the cylinder. The use of a foot valve structure having the same dimensions as the piston is possible because the cylinder has the same internal diameter throughout. Only a simple inward projection is required for supporting the foot valve structure which can be constructed in a simple manner by rings at the joints between adjacent lengths of pipe, by subseqently formed constrictions in the cylinder, by screw clamps, by lacquer or adhesive coatings or by swelling of the wall material of the cylinder by means of solvents. (See for example Technik-Lexikon, Vol. 3 "Werkstoffe and Werkstoffprufungen-Grundlagen", published by Rowohlt Taschenbuchverlag GmbH, October 1971, pages 546–547 and Technik-Lexikon, Vol. 4 "Fertigungstechnik and Arbeitsmaschinen", published by Rowohlt Taschenbuchverlag GmbH, Reinbeck b. Hamburg, July 1972, page 854). There is no need for the bearing surface on the projections to form a seal, since a sealing collar on the foot valve structure, as in the case of the piston, provides the sealing action. Moreover, since the piston and piston valve may be identical with foot valve structure, a piston may also be used as a foot valve structure and vice versa, and the number of the parts subjected to wear which must be maintained is, therefore, halved in a simple pump. And, since in the piston the sealing collar is especially subjected to wear, whereas the identically constructed sealing collar of the foot valve structure is not subjected to any wear, a repair to a worn sealing collar on the piston can be carried out quite simply be exchanging the sealing collars between the foot valve structure and the piston.

In still a further embodiment of the invention, the foot valve structure, below the sealing collar, extends as far as the inner wall of the cylinder and rests upon a projection from the inner wall. As a result, the projection only needs to extend a very small distance into the interior and there is no risk of the foot valve structure only being supported on the sealing collar.

In still a further embodiment of the invention, the foot valve structure is conically shaped in the region at which it bears upon the projection of the cylinder wall. As a result, the foot valve structure is jammed or wedged in place so that it cannot be carried upward by the flow resistance of the pumped liquid during the upward stroke of the pump.

In still a further embodiment of the invention, the projection on the inner wall of the cylinder comprises a local constriction in the cylinder. This constriction can be formed by impressing, additional heat being applied when forming the wall from a thermoplastic material. It is especially advantageous for the projection to be formed of a coating of adhesive or lacquer or by causing local swelling of the inner wall of the plastic cylinder by means of a solvent. Swelling, in particular, provides a very firm projection which, for example, may have the shape of annular elevations. To do this, the interior of the plastic cylinder is coated simply in an annular pattern with a suitable solvent. The plastic material, consequently, swells at the coated regions and, after the solvent has evaporated, does not return to its initial shape, leaving the raised projections.

The foot valve structure may with advantage include a hook, eye or the like to assist in pulling the structure from the cylinder. It may be advantageous to connect the foot valve structure by means of a cord or other flexible member with the piston. The cord is normally slack during operation of the pump. However, if the piston is raised for inspection, the foot valve structure will also be pulled up by the cord so that both can be inspected simultaneously. It is of course also possible for the foot valve structure to be pulled out separately, but then a special grasping device must be lowered in order to lift out the foot valve structure and piston.

It is advantageous if a preferably annular depression is formed in the upper face of the foot valve structure below the sealing collar to form a sump in which sand, which has fallen down through the cylinder extending above ground, can collect so that the sand will not damage the cylinder wall. If this sump slopes towards the valves, the sand will move down through the valves and not cause further damage.

The invention will be explained in more detail with reference to an example of the preferred embodiments shown in the drawing.

In the drawing, a cylinder 1 is shown, in which a piston 2 is moved reciprocatingly by an actuating means, such as a piston rod or cable 3. The piston 2 includes a collar 4 which forms a seal against the cylinder 1 and also includes a valve member 5. The cylinder 1 extends upward beyond the range of movement of the piston 2 and, as shown by an interruption, reaches above ground, where a lateral outlet 6 is provided, through which pumped water is discharged. The cylinder 1 preferably has uniform internal diameter right to the above ground level, so that the piston 2 can be pulled out of the entire cylinder without difficulty.

A foot valve structure 7 is located at the foot of the pump. The foot valve structure 7 is preferably identical in its dimensions with those of the piston 2 and, likewise, comprises a valve 8 and collar 9. The foot valve structure 7 rests on and is supported upon an inward projection 10 of the cylinder 1. The fit between the foot valve structure 7 and support projection 10 does not need to be tight, since the collar 9 ensures the sealing action.

Since the foot valve structure 7 has the same dimensions as the piston 2, it can be raised in the same way as the piston 2 for inspection. An eye 11 is preferably provided for this purpose. Instead of the eye, a hook or a threaded construction may also be provided. It is also possible for the foot valve structure 7 to be connected to the piston 2 by a loose stack flexible member, such as a cord (not shown). When lifting the piston 2 out of the cylinder for inspection purposes, the cord will pull the foot valve structure 7 with it, so that both can be inspected at the same time.

The cylinder 1 extends downward beyond the range of movement of the piston 2 and also beyond the foot valve structure 7. At this location, filter slits 12 are preferably provided in the cylinder so that one and the same tube constitutes the casing of the well, the cylinder for the pump and, in the lower region, a well filter.

The piston rod or cable 3 is connected to one arm 13 of a drive linkage 14, which is anchored separately and independently from the cylinder 1 in the ground by means of rods 15, 16, 17 and 18, so that the upper, above-ground end of the cylinder 1 is not loaded by the drive forces. This is of special advantage when the cylinder 1 is formed of plastic.

Arms 19 extend upward from the upper face of the piston 2 where a threaded sleeve 20 is attached to them, into which a lower, threaded end 21 of the piston rod or cable 3 is screwed. Arms 22 also extend in the same manner from the upper face of the foot valve structure 7 and these arms carry a threaded sleeve 23, into which, instead of the piston rod 3, the threaded end 24 of eye 11 is screwed.

The foot valve structure 7 extends below the sealing collar 9 virtually to the inner wall face of the cylinder 1 and comprises, in the lower region, a conical bearing surface 25, which rests upon a corresponding surface of the annular projection 10 on the inner wall of the cylinder 1. The angle of the bearing surface 25 is relatively slight, so that the foot valve structure 7 is jammed or wedged into position. This wedging action is not so great, however, as to render loosening by pulling on the eye 11 impossible. The inward extension of the projection 10 is shown as being relatively large for reasons of clarity, but in practice the projection need only be very small, since support of the foot valve structure takes place around the entire annular surface of the projection.

Since the foot valve structure 7 and piston 2 are substantially identical in design and dimension, they can be readily interchanged. To do this, the piston rod 3 is screwed into the foot valve member 7 instead of the eye 11, and vice versa.

It should be understood that the embodiments of the present invention which have been described are merely illustrative of a few of the applications of the principles of the invention. Numerous modifications may be made by those skilled in the art without departing from the true spirit and scope of the invention.

What is claimed is:

1. A deep well pump comprising a pump cylinder, adapted to be positioned in the ground, a foot valve structure having a foot valve and coupling means thereon, a valved piston movable in said cylinder over a given range of movement and also having coupling means thereon substantially identical to said first mentioned coupling means, and piston actuating means connected to said piston by said coupling means on said piston and having a length such that the actuating means is adapted to extend above the ground, said cylinder having a length such that it extends for a substantial length beyond said range of movement of the piston and also extends above the ground when the cylinder is positioned in the ground in said deep well and having a substantially constant diameter over its length, said substantially constant diameter cylinder also extending beneath said range of movement of said piston and including filter slits therein, and wherein said foot valve structure and said valved piston are substantially identical to and interchangeable with each other and said valved piston is movable during operation relative to said foot valve structure.

2. The pump of claim 1 wherein said cylinder comprises a plurality of tubes joined together.

3. The pump of claim 1 wherein the length of said piston actuating means is variable such that the range of movement of said piston may be varied.

4. The pump of claim 1 wherein said cylinder is formed of a plastic material.

5. The pump of claim 4 including drive means for driving said piston and piston actuating means, and mounting means mounting said drive means independently of said cylinder.

6. A deep well pump comprising a pump cylinder, adapted to be positioned in the ground, a foot valve structure having a foot valve and coupling means thereon, a valved piston movable in said cylinder over a given range of movement and also having coupling means thereon substantially identical to said first mentioned coupling means, and cable means connected to said piston by said coupling means on said piston and having a length such that the cable means is adapted to extend above the ground, said cylinder having a length such that it extends for a substantial length beyond said range of movement of the piston and also extends above the ground when the cylinder is positioned in the ground when the cylinder is positioned in the ground in said deep well and having a substantially constant diameter over its length, and wherein said foot valve structure and said valved piston are substantially identical to and interchangeable with each other and said valved piston is movable during operation relative to said foot valve structure.

7. A deep well pump comprising a pump cylinder, adapted to be positioned in the ground, a foot valve structure having a foot valve and coupling means thereon, a valved piston movable in said cylinder over a given range of movement and also having coupling means thereon substantially identical to said first mentioned coupling means, and piston actuating means connected to said piston by said coupling means on said piston and having a length such that the actuating means is adapted to extend above the ground, said cylinder having a length such that it extends for a substantial length beyond said range of movement of the piston and also extends above the ground when the cylinder is positioned in the ground in said deep well and having a substantially constant diameter over its length, and supporting means for supporting said foot valve, said supporting means, said foot valve and said piston having dimensions not exceeding said substantially constant diameter, and internal projection means on said cylinder for supporting said supporting means, said projection means extending into said cylinder and having dimensions smaller than said substantially constant diameter, whereby said means for supporting said foot valve is supported upon said projection means and said piston and foot valve are removable from the portion of said cylinder extending above ground, and wherein said foot valve structure and said valved piston are substantially identical to and interchangeable with each other and said valved piston is movable during operation relative to said foot valve structure.

8. The pump of claim 7 wherein said foot valve structure includes means for lifting said foot valve structure from said cylinder.

9. The pump of claim 7 wherein said foot valve structure and said piston are connected by slacked flexible means.

10. The pump of claim 7 wherein said foot valve structure is conical and is wedged against said internal projection means.

11. A deep well pump comprising a pump cylinder, adapted to be positioned in the ground, a foot valve structure having a foot valve and coupling means thereon, a valved piston movable in said cylinder over a given range of movement and also having coupling means thereon substantially identical to said first mentioned coupling means, said piston including depressed sump means which drains to said foot valve, and piston actuating means connected to said piston by said coupling means on said piston and having a length such that the actuating means is adapted to extend above the ground, said cylinder having a length such that it extends for a substantial length beyond said range of movement of the piston and also extends above the ground when the cylinder is positioned in the ground in said deep well and having a substantially constant diameter over its length, and wherein said foot valve structure and said valved piston are substantially identical to and interchangeable with each other and said valved piston is movable during operation relative to said foot valve structure.

12. A deep well pump comprising a pump cylinder, adapted to be positioned in the ground, a foot valve structure having a foot valve, a valved piston movable in said cylinder over a given range of movement, and piston actuating means connected to said piston and having a length such that the actuating means is adapted to extend above the ground, said cylinder having a length such that it extends for a substantial length beyond said range of movement of the piston and also extends above the ground when the cylinder is positioned in the ground in said deep well and having a substantially constant diameter over its length, and supporting means for supporting said foot valve, said supporting means, said foot valve and said piston having dimensions not exceeding said substantially constant diameter, and internal projection means on said cylinder for supporting said supporting means, said projection means extending into said cylinder and having dimensions smaller than said substantially constant diameter, whereby said means for supporting said foot valve is supported upon said projection means and said piston and foot valve are removable from the portion of said cylinder extending above ground, said internal projection means comprising a local constriction on the inner wall of said cylinder, said constriction comprising a plastic portion of the interior of said cylinder which has been solvent swelled.

13. A deep well pump comprising a pump cylinder, adapted to be positioned in the ground, a foot valve structure having a foot valve, a valved piston movable in said cylinder over a given range of movement, and piston actuating means connected to said piston and having a length such that the actuating means is adapted to extend above the ground, said cylinder having a length such that it extends for a substantial length beyond said range of movement of the piston and also extends above the ground when the cylinder is positioned in the ground in said deep well and having a substantially constant diameter over its length, and supporting means for supporting said foot valve, said supporting means, said foot valve and said piston having dimensions not exceeding said substantially constant diameter, and internal projection means on said cylinder for supporting said supporting means, said projection means extending into said cylinder and having dimensions smaller than said substantially constant diameter, whereby said means for supporting said foot valve is supported upon said projection means and said piston and foot valve are removable from the portion of said cylinder extending above ground, said internal projection means comprising a local constriction on the inner wall of said cylinder, said construction comprising a coating on the interior of said cylinder.

* * * * *